United States Patent [19]

Burdet

[11] 4,170,870

[45] Oct. 16, 1979

[54] CONTROL UNIT FOR ELECTRONIC TIME-PIECE DISPLAY

[75] Inventor: Michel Burdet, Aegerten, Switzerland

[73] Assignee: Societe Suisse pour l'Industrie Horlogere Management Services S.A., Switzerland

[21] Appl. No.: 542,656

[22] Filed: Jan. 21, 1975

Related U.S. Application Data

[63] Continuation of Ser. No. 378,626, Jul. 12, 1973, abandoned.

[30] Foreign Application Priority Data

Jul. 12, 1972 [GB] United Kingdom ..... 32576/72

[51] Int. Cl.[2] ..... G04B 19/24; G04C 3/00; G04B 19/30

[52] U.S. Cl. ..... 58/50 R; 58/4 A; 58/23 R; 58/58; 58/85.5

[58] Field of Search ..... 58/4 A, 23 R, 50 R, 58/58, 85.5; 328/14; 324/186

[56] References Cited

U.S. PATENT DOCUMENTS

| | | | |
|---|---|---|---|
| 3,672,155 | 6/1972 | Bergey et al. | 58/50 R |
| 3,810,356 | 5/1974 | Fujita | 58/23 R |
| 3,823,545 | 7/1974 | Vittoz et al. | 58/85.5 X |

*Primary Examiner*—Edith S. Jackmon
*Attorney, Agent, or Firm*—Griffin, Branigan and Butler

[57] ABSTRACT

An electronic time display is provided with two manual switches and a counter for making time corrections. One switch advances the counter to select either the seconds, minutes, hours, or calendar (day) display for correction. The second switch is then used to effect the correction. In order to reduce power consumption and circuit complexity, provision is made for displaying at any particular time either all or a part of the total information available for display.

4 Claims, 5 Drawing Figures

CONTROL UNIT FOR ELECTRONIC TIME-PIECE DISPLAY

RELATED APPLICATIONS

This application is a continuation of my copending application Ser. No. 378,626, filed July 12, 1973 which is now abandoned.

BACKGROUND OF THE INVENTION

The present invention concerns an arrangement for alteration of information as generated by time-pieces having displays of the electronic type. From purely mechanical time-pieces provided with spring balance wheels and mechanical motors, changes over the years have lead to increasing reliance on electrical and electronic means for constituting a time-base. Up until very recently however, such newer generation of time-pieces continued to be provided with the usual mechanical display in which the time of day was read by observing the position of the hands. Generally, digital type presentation of information has been confined to a calendar disk which enables the date to be read through a window of the dial. More recently, there has been a trend on the part of designers to abandon the mechanical type of display in which electrical signals are transmitted into mechanical movements, in favor of purely electronic displays. Time-pieces may thereby be constructed in which there are no moving parts. Displays may continue to be of the analog type in which a pattern of radially arranged line segments about a time-piece dial is successively activated and deactivated. However, the present trend seems to prefer purely digital displays in which a succession of numbers appear on the face of the dial. Such numbers may be formed by line segments arranged in particular patterns, the segments being activated or deactivated through digital decoding circuits. The line segments themselves may be formed from known electrooptic elements such as, for example, light emitting diodes or liquid crystals.

Should it be desired to display four different information sequences in a permanent fashion, i.e. seconds, minutes, hours and calender, it has been found that problems may arise with respect to the power consumption as well as the overall dimensions and complexity of the time-piece. This can constitute a serious problem, particularly with wrist-watches since they must be closely limited in their overall dimensions. Furthermore, the power cells used to energize them should provide a certain minimum life, at present generally about one year.

In considering displays of the digital type, a further problem arises when, for one reason or another, the user wishes to change the information displayed. Time-pieces of the type under consideration generally employ a quartz crystal as the time base and can be regarded as highly accurate, i.e. approximately 5 seconds variation per month. Nevertheless even this small amount of variation may be intolerable to the user of such a time-piece. Furthermore, it will always be necessary to reset such a time-piece to the exact hour, minute and second whenever the power cell is changed. It is also generally necessary to correct the calendar display from time to time. Should the user be a frequent traveller then it is desirable that he be able to change the hour indication whenever a time zone is crossed.

To provide these several types of corrections or information alterations it is of course possible to provide as many control means as there are functions to be realized. One can, for example, provide a control resembling the traditional winding stem on a mechanical watch, which control would operate through electromechanical arrangements, and could be moved to various positions to effect its control functions. Alternately a separate pushbutton may be provided for each type of information to be displayed or corrected. Arrangements such as these have the advantage of being readily understood by the user, but lead to greater complexity in the construction of the time-piece and are of somewhat doubtful reliability. Where a large number of push-buttons are used they will in general detract from the appearance of a time-piece.

SUMMARY OF THE INVENTION

In the present invention for the correction or alteration of the displayed information two push-buttons or similar switches are provided. One of these is employed for actually effecting alterations or corrections and the other is employed for selecting the information which it is intended to alter. Thus in order to bring about, for example, a change in the hour displayed, the selection switch is actuated a certain number of times to effect such selection, thereupon the correction switch would be actuated and would either subtract from or add to the information actually on display. In order that all of the various functions may be accommodated using only two switches it is desirable to provide a form of counter or storage means. This, for example, may comprise an electronic counter actuated by the selection switch in a manner such that each successive actuation increases the count by one. To avoid undesired information changes, when the counter is at a zero count, the gating networks enabled by actuation of the correction switch will be blocked. One arrangement possible therefore is that actuating the switch once will result in the seconds display being subject to alteration, actuating the switch a second time will increase the count by one and cause the minutes display to be subject to alteration, a third actuation will permit corrections of the hour display and further actuation will enable correction of the calender information. A further actuation will clear the counter to zero, whereupon the cycle may be repeated.

Accordingly, the invention provides a control unit adapted for use with electronic time-piece displays wherein a plurality of control switches are provided which are arranged and adapted to alter selectively the information available for display, the arrangement being such that at least one control switch is associated with a counter, the output of which determines the information to be altered so that the number of operations capable of external control exceeds the number of control switches.

One embodiment of the present invention is concerned with displays in which only certain of the available information is permanently shown. This will have the effect of reducing both the power consumption and the circuit complexity. Thus, for example, the hours and minutes can appear permanently in a digital form on the face of the watch. Should it be desired to have the information as to the seconds and the date a push-button is provided and actuation of this push-button operates a switching circuit to change the entire display normally presented permanently. In one arrangement, the entire display may be changed or alternately the hours display may be permanent and the push-button circuits so arranged that a first actuation displays seconds in place of minutes, a second actuation displays the date and a third actuation returns the display to minutes.

BRIEF DESCRIPTION OF DRAWINGS

For a better understanding of the invention, reference will now be had to the accompanying drawing wherein.

DESCRIPTION OF THE INVENTION

It should be noted that the invention is not concerned with the particular type of individual circuits used, it being simply noted that all of these are standard items known to those persons skilled in the art of digital logic. The various selection and switching networks may take the form of arrays of AND and OR gates connected to the requirements of the logic.

In general most circuits will be of the integrated type so that the entire arrangement may be accomodated within, for example, a wrist-watch casing. The switches or push-buttons used for effecting the various control functions may comprise permanent magnets associated with reed type relays, or they may take the form of mechanical contacts.

Figure 1:
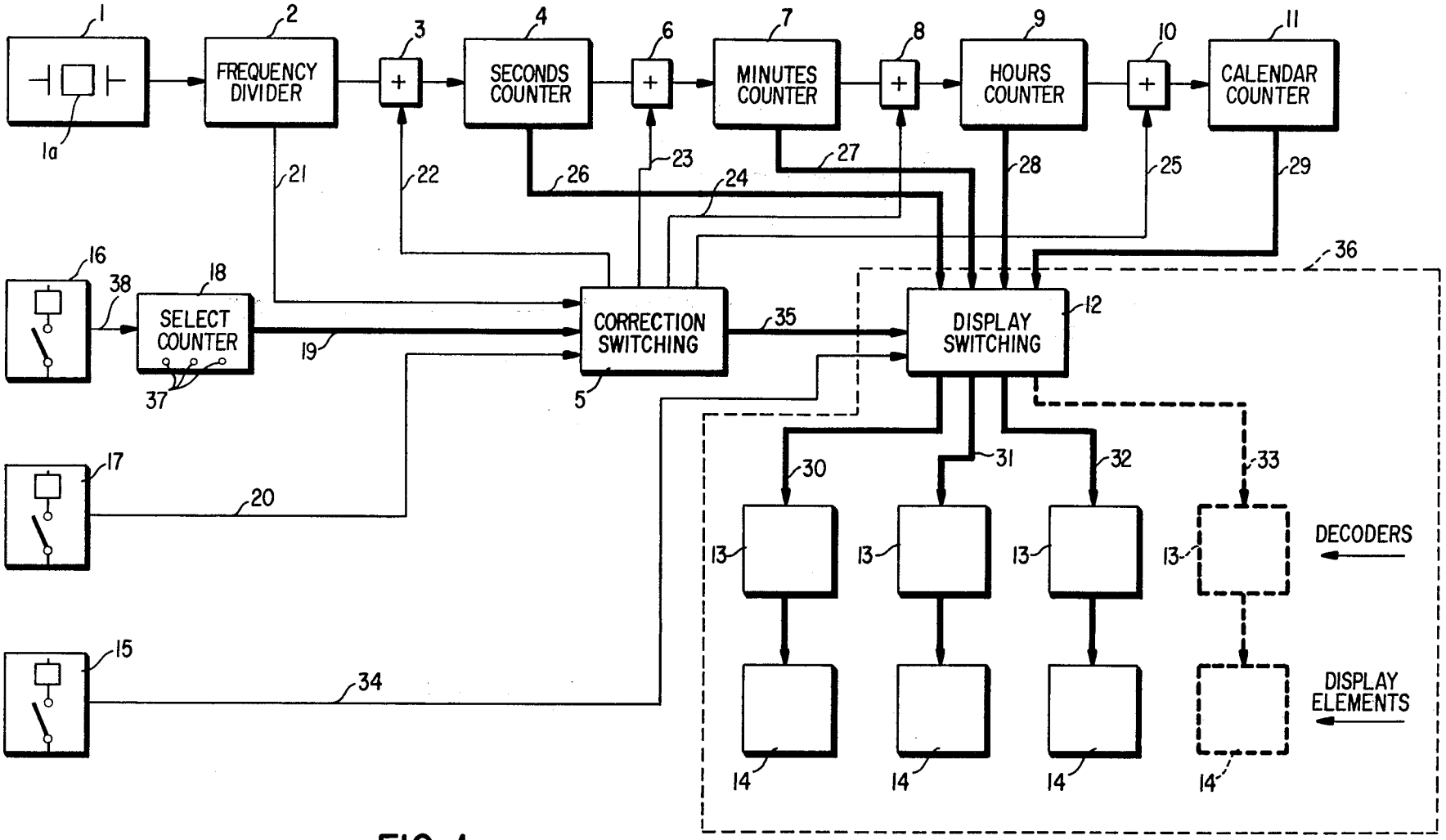
FIG. 1 shows the basic logic for a preferred embodiment of the invention.

The basic arrangement as shown in FIG. 1 comprises an oscillator circuit 1, controlled by a quartz crystal 1*a*, which acts as time standard. In a well known manner the output of the oscillator is transmitted to a frequency divider 2, in which the oscillator output frequency of, for example, 32,768 Hz is reduced to a frequency of 1 Hz. The output of the frequency divider 2 is transmitted via a switching circuit 3 to a seconds counter 4. It is also transmitted to a correction switching network 5.

The output from the seconds counter passes through an electronic switching circuit 6 to a minutes counter 7. The output from the minutes counter 7 passes through an electronic switching circuit 8 to an hours counter 9 and the output from the hours counter 9 passes through a further electronic switching circuit 10 to a calendar counter 11.

Each of the electronic switches 3, 6, 8, and 10 is controlled from the correction switching network 5. The outputs of the counters 4, 7, 9 and 11 are applied to a display means 36 comprising a display switching network 12, a plurality of decoders 13, and a plurality of display elements 14. The output of each counter passes through the display switching network 12, and from the display switching network is transmitted to decoders 13 and subsequently to the display elements 14.

Figure 2:
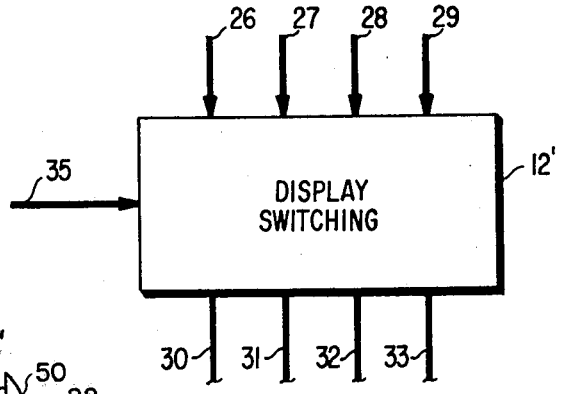
FIG. 2 shows an alternative arrangement of the display switching circuit.

The control of the display by the user is effected by means of three switches which, as previously noted, could be in the form of push-buttons actuating mechanical contacts or acting on permanent magnets associated with reed relays. A switch 15 is provided in the case where, for example, hours and minutes only are displayed in a permanent fashion. Actuation of this switch by the user provides a signal over a lead 34 to the display switching network 12, thereby to connect the seconds counter and the calender counter to the decoders and hence to the display elements in place of the hour and minute counters 9 and 7 respectively. It should be realized that should all 4 types of information, i.e. seconds, minutes, hours and calender, be simultaneously displayed then switch 15 would be unnecessary. This modification is schematically illustrated in FIG. 2.

Alteration of information is effected by means of a selector switch 16 and a corrector switch 17. Selector switch 16 provides signals to a select counter circuit 18 and the output of counter circuit 18, which will represent various counts depending on how many times switch 16 has been actuated, is applied to the correction switching circuit 5. Also applied to correction switching circuit 5 is the output signal from correction switch 17.

A preferred arrangement provides that so long as the count stored in counter 18 is zero, actuation of correction switch 17 has no effect on the correction switching network 5 and thus is ineffective to change any information actually displayed. In line with the foregoing it is desirable to provide an automatic clearing of counter 18 following a predetermined delay. This will ensure that accidental settings or user forgetfulness will not lead to undesired changes.

Figure 5:
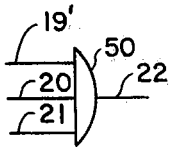
FIG. 5 shows the symbol for a typical logic gating element.

Various correction possibilities exist, but as shown in the drawing it may be presupposed that one actuation of selection switch 16 will shift the counter 18 to the count of one at which count the seconds display may be corrected. Subsequent actuation of switch 17 would then provide a gating signal to enable a higher frequency pulse train obtained from an intermediate stage of divider 2 over a lead 21 to be passed through the correction switching network 5, over lead 22, and through electronic switch 3 into the seconds counter 4, thereby to advance the count stored in counter 4 at a frequency higher than normal. This function may be accomplished by a logical AND circuit 50 as illustrated in FIG. 5. The use of AND circuits in electronic timekeeping apparatus is taught by U.S. Pat. No. 3,823,545. Alternatively, a circuit may also be provided by means of which successive individual actuations of switch 17 would add one for each actuation to the count stored in counter 4. A circuit for accomplishing this is disclosed in commonly assigned application Ser. No. 312,328 filed Dec. 5, 1972, now U.S. Pat. No. 3,786,625.

Should next the selection switch 16 be again actuated, the counter 18 will advance so as to store a count of two and such count is decoded by another AND circuit like 50 in the correction switching network 5 to thereby direct the pulse train from the divider 2 to the minutes counter 7 via lead 23 and switch 6. As in the case of the seconds correction, minutes corrections may be effected by successive actuations of switch 17. In a like manner, setting counter 18 to the count of three will transfer the output of the correction switch 17 to the hours counter 9 via a third AND circuit 50, lead 24 and switch 8, and advancement of the counter 18 to the count of four will enable correction of the calendar counter 11 by way of a fourth AND circuit 50, lead 25 and switch 10. It will be appreciated that the user of such an arrangement will wish to known what count is currently stored in the counter. For this purpose various arrangements may be provided, for example a pilot display may be provided in which a separate pilot 37 becomes visible for each of the counts stored by the counter. As long as the counter is cleared none of the pilots 37 are visible and the user knows that no effect would be produced through actuation of the correction switch 17.

Figure 3:
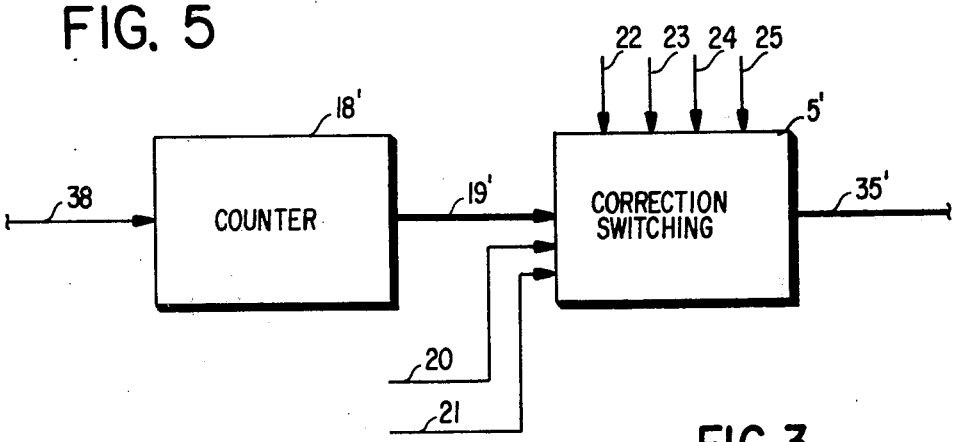
FIG. 3 schematically illustrates a modification wherein all information is normally simultaneously displayed but all information other than that being corrected is extinguished upon each actuation of a selection switch.

In the case where all four types of information are simultaneously displayed the circuits may be designed so that each actuation of selection switch 16 will extinguish all information save that which is to undergo correction. This circuit arrangement is schematically illustrated in FIG. 3.

Figure 4:
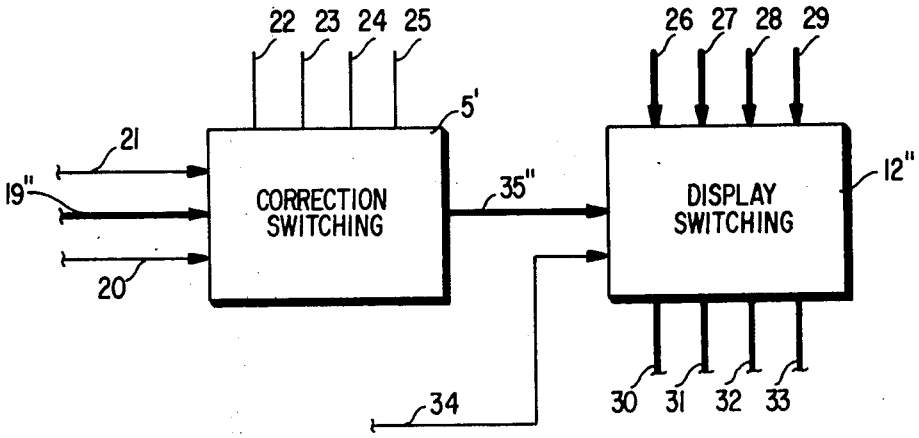
FIG. 4 illustrates an alternative embodiment wherein there is an automatic display of the time information being corrected.

Still other forms are possible, as for instance where only two of the information sequences are permanently displayed, in order to distinguish between displays, it is foreseen that the normal display of hours and minutes will flash on and off. When the display is changed to that of calender and seconds, this will normally be shown in a continuous manner. However when the user wishes to effect a correction, as soon as the counter 18 has reached a count corresponding to seconds or calender correction the circuit arrangement may be such as to bring about the automatic display of this information which normally is presented only by acting on switch 15. FIG. 4 schematically illustrates this alternative arrangement.

Thus when the seconds display is to be corrected, the hours and minutes display is extinguished and seconds only are displayed during correction. Similarly by actuating switch 16 to select minutes, the hour display is extinguished and minutes only are displayed, but in a flashing manner, in order to distinguish from the second display. In the case where the counter 18 is advanced for correction of the hour, the minute display is extinguished and the hour display continues in a flashing manner. Should it be desired to correct the calender, the display is in what is normally the hour position, but would be continuous rather than flashing. Obviously the choice as to which displays are continuous and which are flashing is an arbitrary one which may be varied in accordance with the designer's judgment.

What is claimed is:

1. In an electronic time-piece having a time standard, a plurality of time keeping counters connected in series, means responsive to said time standard for applying a sequence of time pulses to one of said time keeping counters, and display means responsive to said time keeping counters for displaying information contained in said time keeping counters, the improvement comprising a time correction means having only two manual switches for effecting time correction, said time correction means comprising:

selection counter means;

a manually operable selection switch means connected to said selection counter for advancing the count therein to select one of said time keeping counters for correction;

a correction switching means;

a manually operable correction switch means for controlling said correction switching means;

means responsive to said time standard for applying a sequence of correction pulses to said correction switching means;

means for applying to said correction switching means signals representing the count in said selection counter means; and, means connecting said correction switching means to said time keeping counters so as to direct said correction pulses to the time keeping counter specified by the count in said selection counter means when said manually operable correction switch means is operated.

2. The improvement as claimed in claim 1 wherein said display means comprises means for simultaneously displaying the information contained in all said time keeping counters.

3. The improvement as claimed in claim 1 wherein said display means includes electro-optical displays and display switching means responsive to said time keeping counter means for operating selected ones of said displays.

4. The improvement as claimed in claim 1 wherein said display means includes electro-optical displays, a manually operable control switch, and display switching means responsive to said time keeping counter means and said control switch for activating said displays.

* * * * *